US012297845B2

(12) United States Patent
Yamarthi et al.

(10) Patent No.: US 12,297,845 B2
(45) Date of Patent: May 13, 2025

(54) VORTEX COOLED SECONDARY FLOW FOR A SUPERCRITICAL CARBON DIOXIDE PUMP

(71) Applicant: General Electric Company, Schenectady, NY (US)

(72) Inventors: David Raju Yamarthi, Bengaluru (IN); David Justin Brady, Lynn, MA (US); Adam Joseph Wangler, Evendale, OH (US); Santosh Kumar Pattnaik, Bengaluru (IN)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/496,599

(22) Filed: Oct. 27, 2023

(65) Prior Publication Data

US 2024/0263646 A1 Aug. 8, 2024

(30) Foreign Application Priority Data

Jan. 9, 2023 (IN) ..... 202311001697

(51) Int. Cl.

| | |
|---|---|
| ***F04D 29/58*** | (2006.01) |
| ***F04D 17/08*** | (2006.01) |
| ***F04D 27/02*** | (2006.01) |
| ***F04D 29/056*** | (2006.01) |

(52) U.S. Cl.

CPC ..... *F04D 29/5826* (2013.01); *F04D 17/08* (2013.01); *F04D 27/023* (2013.01); *F04D 29/056* (2013.01)

(58) Field of Classification Search

CPC .... F04D 29/5826; F04D 17/08; F04D 27/023; F04D 29/056

See application file for complete search history.

(56) References Cited

U.S. PATENT DOCUMENTS

| | | | | |
|---|---|---|---|---|
| 3,377,779 | A * | 4/1968 | Kronk | F16N 39/002 96/212 |
| 3,748,507 | A * | 7/1973 | Sieber | H02K 9/14 310/58 |
| 3,936,240 | A | 2/1976 | Dochterman | |
| 4,646,524 | A * | 3/1987 | Kawashima | F25B 9/04 62/402 |

(Continued)

FOREIGN PATENT DOCUMENTS

| | | | |
|---|---|---|---|
| CN | 110925033 | A | 3/2020 |
| CN | 113898427 | A | 1/2022 |
| EP | 3805529 | A1 | 4/2021 |

*Primary Examiner* — Jesse S Bogue

(74) *Attorney, Agent, or Firm* — Hanley, Flight & Zimmerman, LLC

(57) ABSTRACT

Methods and apparatus to provide vortex cooled secondary flow for a supercritical carbon dioxide pump are disclosed herein. An example thermal management system includes a hot secondary flow extract section fluidly coupled to an outlet of a pump system, a cooled secondary flow section fluidly coupled to the hot secondary flow extract section, the hot secondary flow extract section including a vortex tube to generate cooled secondary air flow from hot secondary flow extract air of the hot secondary flow extract section, and a bearing inlet fluidly coupled to the cooled secondary flow section, the bearing inlet positioned to route the cooled secondary flow to bearings of the pump system.

8 Claims, 7 Drawing Sheets

(56) References Cited

U.S. PATENT DOCUMENTS

| | | | | |
|---|---|---|---|---|
| 5,113,670 | A * | 5/1992 | McAuliffe | F01D 25/166 417/406 |
| 7,469,689 | B1 * | 12/2008 | Jones | F04D 25/16 123/41.31 |
| 8,714,919 | B2 | 5/2014 | Gibson et al. | |
| 9,863,430 | B2 * | 1/2018 | Lee | H01M 8/04089 |
| 9,932,861 | B2 | 4/2018 | Preuss et al. | |
| 10,344,608 | B2 | 7/2019 | Gaia et al. | |
| 10,443,438 | B2 | 10/2019 | Phui et al. | |
| 10,487,722 | B2 * | 11/2019 | Hu | F02M 26/05 |
| 10,704,739 | B2 * | 7/2020 | Guo | F17D 1/02 |
| 2013/0167557 | A1 * | 7/2013 | Kim | F25J 3/04248 62/640 |
| 2014/0328666 | A1 | 11/2014 | Christopher | |
| 2015/0337850 | A1 * | 11/2015 | An | F04D 29/284 417/423.13 |
| 2019/0345956 | A1 * | 11/2019 | Iizuka | F04D 25/0606 |
| 2021/0340914 | A1 | 11/2021 | Niergarth et al. | |

* cited by examiner

VORTEX COOLED SECONDARY FLOW FOR A SUPERCRITICAL CARBON DIOXIDE PUMP

RELATED APPLICATIONS

This patent arises from a continuation of Indian patent application Ser. No. 202311001697, filed on Jan. 9, 2023. Indian patent application Ser. No. 202311001697 is hereby incorporated herein by reference in its entirety.

FIELD OF THE DISCLOSURE

This disclosure relates generally to fluid pumps, and, more particularly, to cooling of a carbon dioxide pump.

BACKGROUND

Aircraft typically include various accessory systems supporting the operation of the aircraft and/or its gas turbine engine(s). For example, such accessory systems may include a lubrication system that lubricates components of the engine(s), an engine cooling system that provides cooling air to engine components, an environmental control system that provides cooled air to the cabin of the aircraft, and/or the like. As such, heat is added or removed from a fluid (e.g., oil, air, etc.) during operation of these accessory systems.

BRIEF DESCRIPTION OF THE DRAWINGS

A full and enabling disclosure of the present technology, including the best mode thereof, directed to one of ordinary skill in the art, is set forth in the specification, which makes reference to the appended Figures, in which.

In general, the same reference numbers will be used throughout the drawing(s) and accompanying written description to refer to the same or like parts. The figures are not substantially to scale.

DETAILED DESCRIPTION

Figure 1:
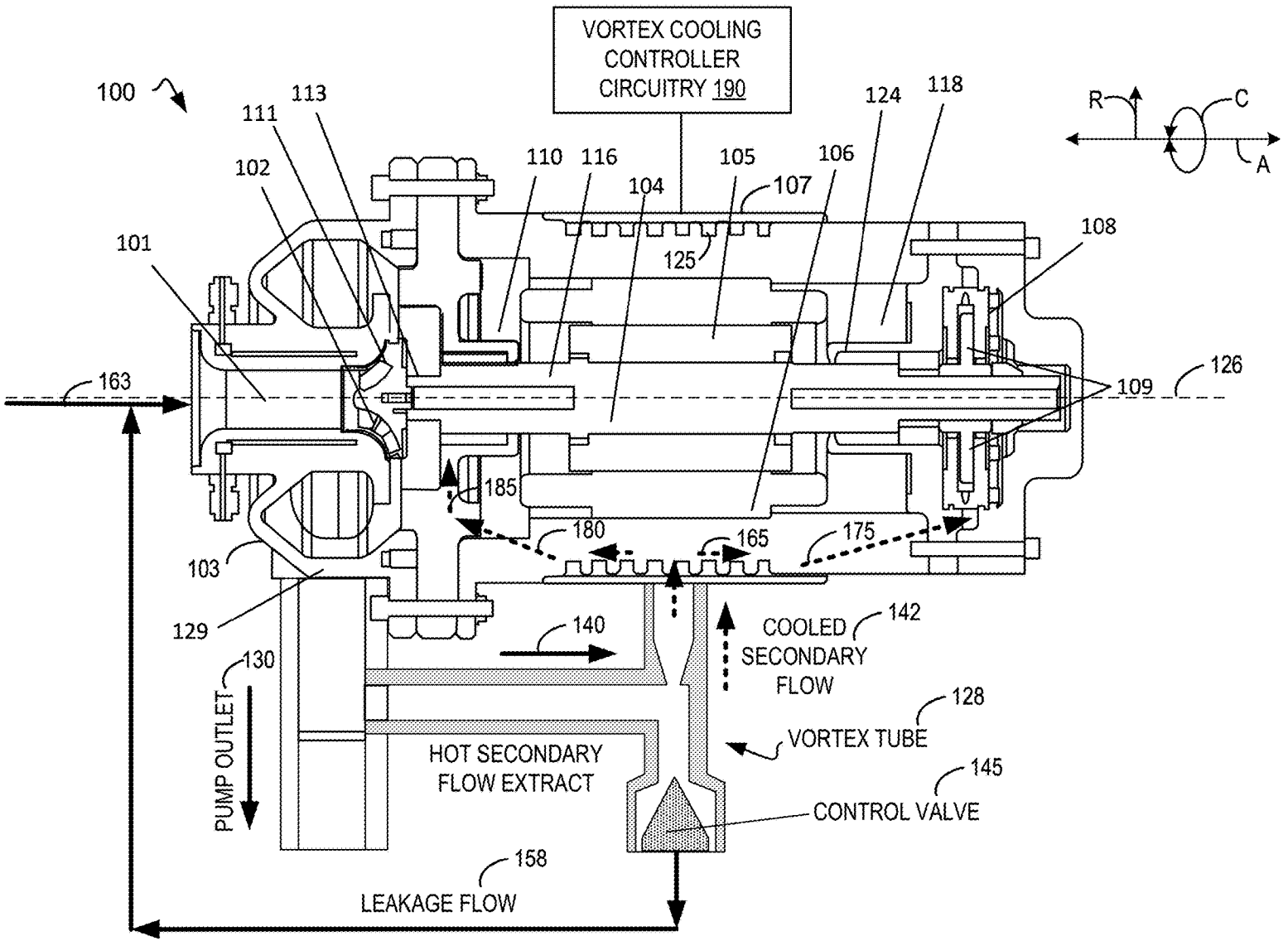
FIG. 1 schematically illustrates an example cross-sectional view of a vortex tube for cooling a motor cooling jacket and bearings of a supercritical carbon dioxide pump in accordance with teachings disclosed herein.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

As used herein, unless otherwise stated, the term "above" describes the relationship of two parts relative to Earth. A first part is above a second part if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another.

As used in this application, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin.

The terms "forward" and "aft" refer to relative positions within a gas turbine engine, pump, or vehicle, and refer to the normal operational attitude of the gas turbine engine, pump, or vehicle. For example, with regard to a gas turbine engine, forward refers to a position closer to an engine inlet and aft refers to a position closer to an engine nozzle or exhaust. Further, with regard to a pump, forward refers to a position closer to a pump inlet and aft refers to a position closer to an end of the pump opposite the inlet.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows.

As used herein, the phrase "in communication," including variations thereof, encompasses direct communication and/or indirect communication through one or more intermediary components, and does not require direct physical (e.g., wired) communication and/or constant communication, but rather additionally includes selective communication at periodic intervals, scheduled intervals, aperiodic intervals, and/or one-time events.

As used herein, "processor circuitry" is defined to include (i) one or more special purpose electrical circuits structured to perform specific operation(s) and including one or more semiconductor-based logic devices (e.g., electrical hardware implemented by one or more transistors), and/or (ii) one or more general purpose semiconductor-based electrical circuits programmed with instructions to perform specific operations and including one or more semiconductor-based logic devices (e.g., electrical hardware implemented by one or more transistors). Examples of processor circuitry include programmed microprocessors, Field Programmable Gate Arrays (FPGAs) that may instantiate instructions, Central Processor Units (CPUs), Graphics Processor Units (GPUs), Digital Signal Processors (DSPs), XPUs, or microcontrollers and integrated circuits such as Application Specific Integrated Circuits (ASICs). For example, an XPU may be implemented by a heterogeneous computing system including multiple types of processor circuitry (e.g., one or more FPGAs, one or more CPUs, one or more GPUs, one or more DSPs, etc., and/or a combination thereof) and application programming interface(s) (API(s)) that may assign computing task(s) to whichever one(s) of the multiple types of the processing circuitry is/are best suited to execute the computing task(s).

Centrifugal fluid pumps move fluid through systems by converting rotational kinetic energy of an impeller to hydrodynamic energy of a flowing fluid. In other words, the angular velocity of the impeller is directly proportional to the flow rate of the flowing fluid exiting the pump. The impeller is provided a change in rotational kinetic energy from an electric motor applying mechanical work to an impeller shaft coupled to the impeller and to the rotor of the electric motor. The rotor is provided a change in mechanical work over a period of time (i.e., mechanical power) from a stator in the electric motor applying electromagnetic forces to the rotor in the form of torque. If the motor supplies a constant amount of electrical energy to the stator, then the rotor will supply a constant amount of mechanical energy to the impeller. In this case, the mechanical power supplied to the pump by the electric motor would be equal to the quotient of the rotational kinetic energy and the amount of time the power is being supplied. In rotational systems, such as a centrifugal fluid pump, the mechanical power of the impeller is equal to the product of the torque and the angular velocity. When the rotor of the electric motor and the impeller shaft of the centrifugal fluid pump are coupled axially, the torque and angular velocity of the rotor transfer to the impeller. Such centrifugal pumps can be utilized to drive a heat exchange fluid through a thermal transport bus to maintain working fluids and/or components of a system within a certain temperature range.

Conventional thermal transport systems utilize a centrifugal pump that drives the heat exchange fluid through one or more heat sink or source heat exchangers to control the thermal energy within the system. Accordingly, the thermal transport bus can carry the heat exchange fluid to components of a system that need to be cooled or heated for certain operations. Further, conventional thermal transport systems utilize heat sink heat exchangers to cool the heat exchange fluid and enable the cooled heat exchange fluid to cool pump components, such as a motor. However, heat sink heat exchangers increase a size, a weight, and a cost of the thermal transport system.

Examples disclosed herein introduce the use of a vortex tube (e.g., a mechanical-thermal device that separates a compressed flow of air into hot and cold streams) in place of heat exchangers to control thermal energy to maintain working fluids and/or components of a system within a certain temperature range. In examples disclosed herein, the vortex tube can be positioned to cool down secondary flow and use the cooled flow for electrical motor cooling and/or as a working medium for bearings of a supercritical carbon dioxide pump. In some examples, leakage flow from the vortex tube can be routed back into the pump inlet and/or pump outlet. In examples disclosed herein, compressed air from an engine (e.g., an aircraft engine) can be passed through the vortex tube, causing an air temperature drop in the vortex tube, with the resulting cooled air passed through a heat exchanger. In examples disclosed herein, cooling of the secondary flow reduces vibrations encountered by the motor shaft at higher temperatures (e.g., temperatures greater than 200 degrees Fahrenheit (° F.)). Furthermore, the use of the vortex tube can be used to eliminate additional weight associated with heat exchanger(s) and/or existing heat exchanger network(s) for secondary flow and motor cooling. As such, methods and apparatus disclosed herein for vortex cooled secondary flow for a supercritical carbon dioxide pump improve overall electrical motor stability and reliability through effective thermal management.

For the figures disclosed herein, identical numerals indicate the same elements throughout the figures. Referring now to the drawings, FIG. 1 schematically illustrates an example use of a vortex tube to cool a motor cooling jacket and bearings of a pump system 100 in accordance with teachings disclosed herein. In the example of FIG. 1, the pump system 100 is configured to pump heat exchange fluid through a thermal transport bus. For example, the pump system 100 can be used for pressurizing fluid (e.g., a heat exchange fluid such as a supercritical fluid (e.g., supercritical carbon dioxide (sCO2), etc.)) in a system (e.g., thermal management system). In some examples, the pump system 100 drives the flow of the heat exchange fluid through a thermal management system associated with an aircraft and/or a gas turbine engine. In examples disclosed herein, the pump system 100 is a supercritical carbon dioxide pump. For example, the pump system 100 uses supercritical carbon dioxide as the working fluid in a closed or semi-closed Brayton thermodynamic cycle, allowing thermal energy to be converted to electrical energy. For example, the carbon dioxide is kept at supercritical conditions throughout the cycle, given that the Brayton thermodynamic cycle operates in a single phase (e.g., no condensation or phase change occurs). For example, carbon dioxide can be compressed directly to supercritical pressures and heated to a supercritical state at moderate conditions. Use of supercritical carbon dioxide improves energy efficiency by reducing the size of system components (e.g., turbine, heat exchangers, etc.) given the high density and volumetric heat capacity of supercritical carbon dioxide.

In the example of FIG. 1, a cross-sectional view of the pump system 100 includes an inlet 101, an impeller 102, a compressor casing 103, a rotor shaft 104, a rotor 105, a stator 106, a motor casing 107, a thrust bearing 108, radial shafts 109, a first integrated bearing system 110, a compressor 111, a bearing housing 113, a first foil bearing 116, a second integrated bearing system 118, a second foil bearing 124, a cooling jacket 125 positioned around the motor casing 107, and an outlet 129. A rotational axis of the shafts 109 defines an axial centerline 126 of the pump system 100. In the example of FIG. 1, a vortex tube 128 is in connection with the pump system 100. The vortex tube 128 receives hot secondary flow extract from the outlet 129 via a pump outlet section 130. In the example of FIG. 1, the vortex tube includes a hot secondary flow extract section 140, a cooled secondary flow section 142, and a control valve section 145 for directing leakage flow 158 towards the inlet 101 (e.g., the inlet 101 receiving fluid 163 flowing in an axial direction A that enters the compressor casing 103). The leakage flow 158 is mixed back with the bulk of the inlet flow 163 entering the pump system 100 and passing through the impeller 102. Furthermore, the pump system 100 of FIG. 1 includes vortex cooling controller circuitry 190 communicatively coupled to the pump system 100. Specifically, the vortex cooling controller circuitry 190 can be communicatively coupled to a motor of the pump system 100. In the illustrated example of FIG. 1, the vortex cooling controller circuitry 190 controls secondary flow extract cooling using the vortex tube 128 based on the positioning of the vortex tube 128 with respect to the pump system 100, as described in more detail in connection with FIG. 5.

The example pump system 100 illustrated in FIG. 1 includes the impeller 102 to pressurize the fluid (e.g., sCO2) in the system (e.g., a thermal management system). The example impeller 102 is a component of the pump system 100 that is connected to the rotor shaft 104 and rotates at a same rotational speed as the rotor shaft 104. In some examples, the impeller 102 is same as or similar to impellers used in centrifugal pumps and includes vanes and/or blades to deflect flow of the incoming fluid radially outward into outlet flowlines. The example impeller 102 converts mechanical power of the motor (e.g., the rotor shaft 104 and the stator 106) into hydrodynamic power of the fluid flow.

The example pump system 100 illustrated in FIG. 1 includes the stator 106 to apply a torque on the rotor 105, which is coupled to the rotor shaft 104. Since the example rotor 105 is connected to the rotor shaft 104 (e.g., via bolts, adhesives, interference fit, etc.), the stator 106 causes the rotor shaft 104 to rotate while the stator 106 remains stationary. The example stator 106, the example rotor 105, and the example rotor shaft 104 are included as parts of an electric motor that is familiar to those with skill in the art. In some examples, the stator 106 includes field magnets (e.g., electromagnets or permanent magnets) that generate magnetic field(s) based on an electric current (e.g., direct current or alternating current) passing through various the electromagnets of the stator 106. The example stator 106 generates a first set of magnetic fields that apply a force (e.g., Lorentz force) on a second set of magnetic fields that the rotor 105 generates. The example rotor 105 generates the second set of magnetic fields via permanent magnets or electromagnets. Since the example stator 106 is stationary and fixed in place, the force causes the example rotor 105 to rotate and to produce a torque. Since the example rotor shaft 104 is connected to the example rotor 105, the rotor shaft 104 produces the same torque and rotates at a same angular velocity as the rotor 105.

The example pump system 100 illustrated in FIG. 1 includes the thrust bearing 108 to support the thrust load (axial load) that the rotor shaft 104 generates during operation. The example thrust bearing 108 illustrated in FIG. 1 is a foil bearing that includes a spring-loaded foil and a journal lining. The example rotor shaft 104 is connected to two or more radial shafts 109 that are positioned perpendicular to the axis of rotation of the rotor shaft 104. The example pump system 100 includes two radial shafts 109.

The example pump system 100 of FIG. 1 includes the first integrated bearing system 110 to support the radial loads of the rotor shaft 104 during operation of the pump system 100. The example first integrated bearing system 110 includes the bearing housing 113 and the first foil bearing 116. The pump system 100 includes the foil bearing 116 to support the radial load of the rotor shaft 104. The inner lining and journal lining of the example foil bearing 116 are able to rotate freely in either direction. The example pump system 100 includes the bearing housing 113 to support the rolling-element bearing and the foil bearing 116. In some examples, the bearing housing 113 securely supports the rolling-element bearing and the foil bearing 116 via bolts, dowels, pins, adhesives, and/or interference fits.

The example pump system 100 also includes the second integrated bearing system 118 to similarly support the radial loads of the rotor shaft 104. The second integrated bearing system 118 includes the second foil bearing 124. In some examples, the pump system 100 includes one integrated bearing system. In some examples, the pump system 100 includes one or more integrated bearing systems. The example first integrated bearing system 110 and the example second integrated bearing system 118 of the example pump system 100 are substantially similar. Thus, references and descriptions regarding the first integrated bearing system 110 and the first foil bearing 116 can also be applied to the second integrated bearing system 118 and the second foil bearing 124, respectively. In some examples, the integrated bearing system 110, 118 includes a rolling-element bearing to support the radial load of the rotor shaft 104 at an operational speed range. For example, the rolling-element bearing can include an inner race, an outer race, and rolling elements (e.g., balls, spheres, cylinders, etc.) that are able to rotate freely in either direction. In some examples, the rolling-element bearing includes liquid lubricant (e.g., oil, grease, etc.) to reduce the friction forces within the rolling-element bearing and increase the lifespan of the rolling-element bearing.

During operation, inlet flow 163 flows in an axial direction A defined by the pump system 100 through the inlet 101 and into the compressor casing 103. The compressor 111 drives the fluid in a radial direction R defined by the pump system 100 and causes the fluid to flow through the outlet 129. Specifically, the fluid that exits the compressor casing 103 through the outlet 129 flows in a first radial direction (e.g., downwards in the view of FIG. 1, away from the axial centerline 126). The compressor 111 causes the fluid to compress, which increases a temperature of the fluid. Specifically, the compressor casing 103 defines a flow path for the inlet flow 163 between the compressor 111 and the inlet 101 and between the compressor 111 and the outlet 129. The compressor 111 pumps the fluid from the inlet 101 and into the outlet 129 to increase the pressure and the temperature of the fluid. Thus, the compressor 111 causes the pressure of the fluid to increase from a first pressure as the fluid flows through the inlet 101 to a second pressure as the fluid flows through the outlet 129.

In the example of FIG. 1, the vortex tube 128 is positioned to receive a portion of the pressurized flow coming from the impeller 102. For example, the vortex tube 128 receives compressed fluid flow exiting the outlet 129 via the pump outlet section 130 adjacent to the outlet 129 of the compressor casing 103. Hot secondary flow extract originating from the pump outlet section 130 flows into the hot secondary flow extract section 140. In the example of FIG. 1, the vortex tube 128 provides cooled secondary flow to the cooling jacket 125 and bearings (e.g., the first foil bearing 116 of the first integrated bearing system 110, the second foil bearing 124 of the second integrated bearing system 118). In examples disclosed herein, the vortex tube 128 can be used to provide a cooled pressurized flow to the bearing supply of the pump system 100. For example, the vortex tube 128 can be used to centrifuge the gaseous carbon dioxide flow to separate a cold flow stream from a hot flow stream, with the cooler flow stream directed back towards the pump system 100 to provide lubrication to the bearing set (e.g., an inner lining and journal lining of the foil bearing 116). For example, lubrication of the bearing set allows for the thrust bearing 108 to prevent contacting the radial shafts 109 due to the presence of a hydrodynamic film that forms due to lubrication between these pump system 100 structures, allowing rotating parts to rotate at high-speed relative to the static parts of the pump system 100. For example, the vortex tube 128 allows for a flow of highly compressed air (e.g., originating from the outlet 129 via the pump outlet section 130) to pass through a nozzle that is designed to move the air tangentially within the vortex tube 128, resulting in a high-speed vortex movement. The vortex tube nozzle forces the whirling airflow to alter its direction and pass through the length of the tube 128 in the form of a rotating shell, as described in more detail in connection with FIG. 3.

For example, the vortex tube 128 includes a control valve 145 positioned radially with respect to the hot secondary flow extract section 140. The control valve 145 allows for a portion of the air to escape as leakage flow 158, forcing the remainder of the air to return to the inner section of the vortex tube as a second vortex. The formation of the vortex causes the hot air to give off kinetic energy in the form of heat (e.g., within the hot secondary flow extract section 140), before exiting the vortex tube through the cooled secondary flow section 142 and into the pump system 100. The control valve 145 can be used to regulate the amount of cold air and corresponding air temperature. The cooled air exists the cooled secondary flow section 142 of the vortex tube 128 and enters the pump system 100, proceeding to cool the cooling jacket 125 via cooled air flow 165, with the cooled air further split into cooled air flow 175, 180, 185 movement towards the pump system 100 structures (e.g., the bearing cavity). For example, in place of using a cooling medium (e.g., water/glycol mixture) around the cooling jacket 125 of the motor associated with the pump system 100, the cooled secondary flow originating from the cooled secondary flow section 142 of the vortex tube 128 can be used to cool the motor housing (e.g., cooling jacket 125).

Figure 2:
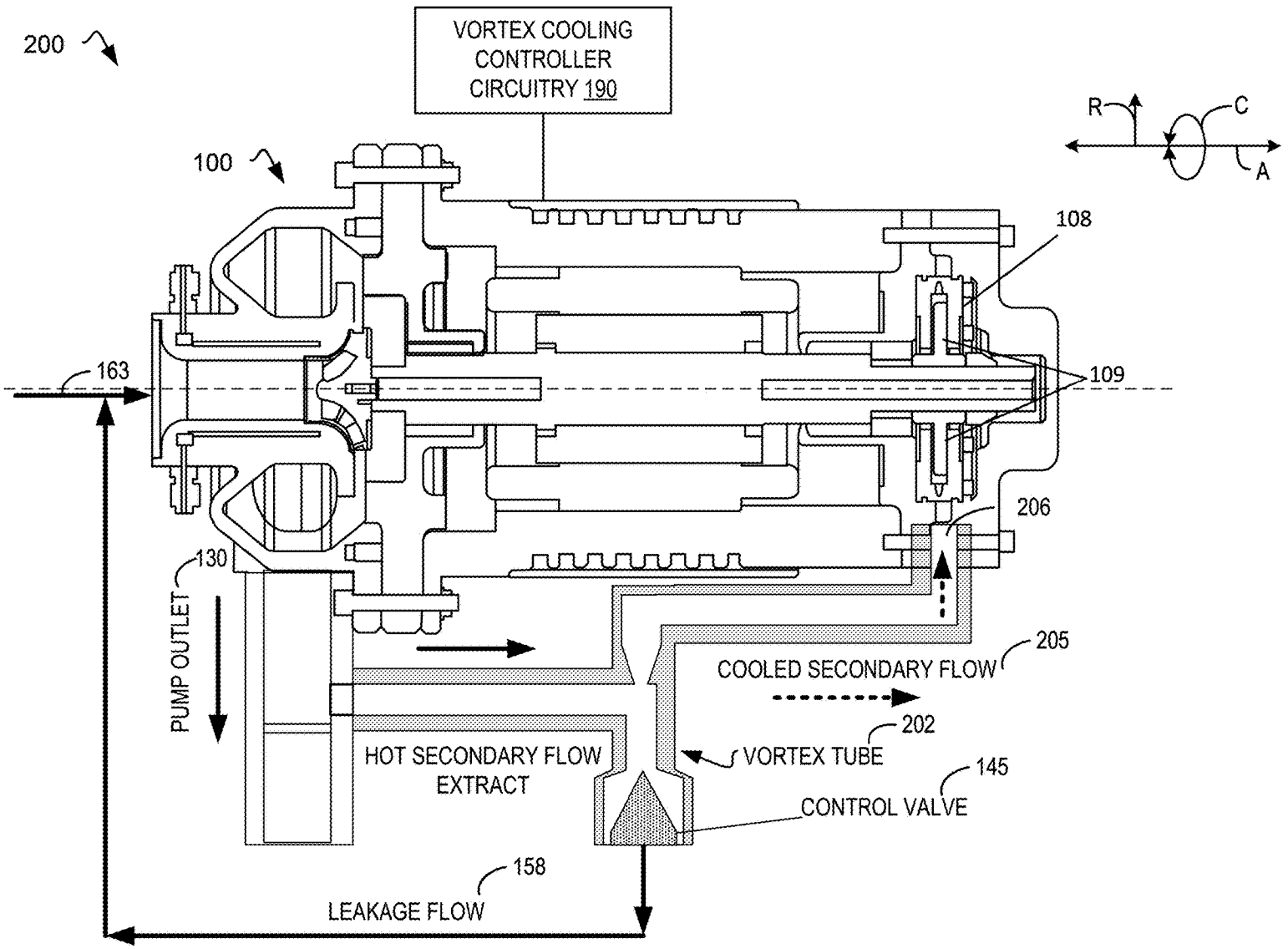
FIG. 2 schematically illustrates an example cross-sectional view of a vortex tube for lubricating bearings of a supercritical carbon dioxide pump in accordance with teachings disclosed herein.

FIG. 2 schematically illustrates an example cross-sectional view 200 of a vortex tube 202 used to lubricate bearings of a supercritical carbon dioxide pump system 100 in accordance with teachings disclosed herein. In the example of FIG. 2, the vortex tube 202 includes an elongated cooled secondary flow section 205 for directing the cooled secondary flow towards the bearings of the pump system 100. For example, the cooled secondary flow section 205 of the vortex tube 202 transports the cooled air directly towards the thrust bearing 108 (e.g., in contact with radial shafts 109) via the pump system bearing inlet 206, in contrast to the cooled secondary flow section 142 of the vortex tube 128 that transports cooled air towards the bearing of the pump system 100 via the cooling jacket 125. In the example of FIG. 2, the vortex tube 202 cooling flow can be regulated using the control valve 145 of FIG. 1 to determine the amount of leakage flow 158 mixing with the receiving fluid 163 entering the pump system 100 to be compressed and further released into the vortex tube 202 via the pump outlet section 130. In some examples, the secondary flow used to provide cooling to the pump system 100 via the vortex tube(s) 128, 202 can be extracted from the inlet and/or the outlet of the pump system 100. In examples disclosed herein, the vortex cooling controller circuitry 190 can be used to regulate the control valve 145 to determine the amount of cooling needed based on sensor(s) positioned in the pump system 100, as described in more detail in connection with FIGS. 5-6. However, the control valve 145 can be either active or passive.

Figure 3:
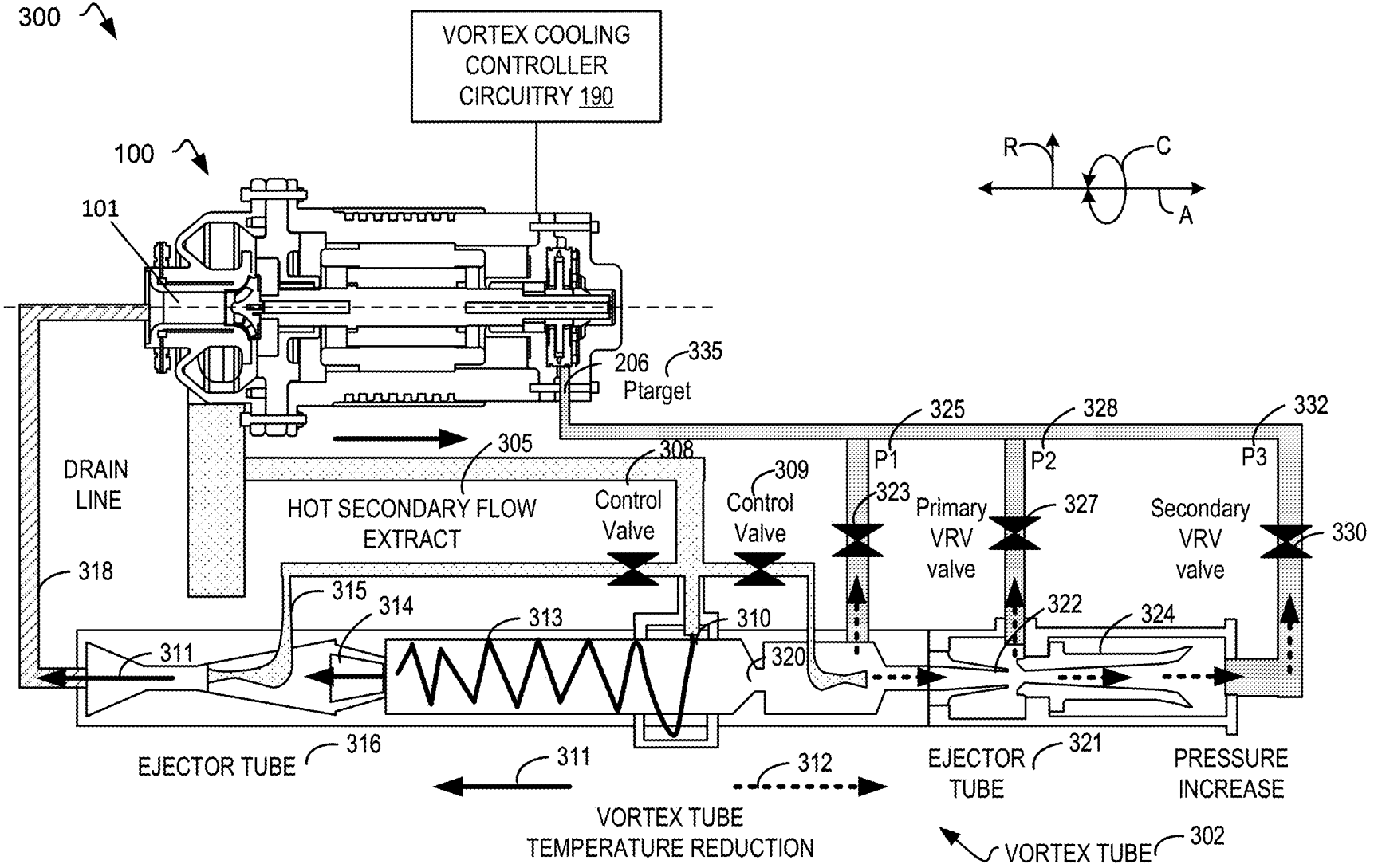
FIG. 3 schematically illustrates an example cross-sectional view of a vortex tube for gaseous media temperature reduction in accordance with teachings disclosed herein.

FIG. 3 schematically illustrates an example cross-sectional view 300 of a vortex tube 302 used for gaseous media temperature reduction within the pump system 100 in accordance with teachings disclosed herein. In the example of FIG. 3, the vortex tube 302 receives hot secondary flow extract 305 originating from the pump system 100, as described in connection with FIG. 1. For example, the hot secondary flow extract 305 originating from the pump system 100 can be a portion of the flow existing the compressor casing 103 of FIG. 1. To achieve target pressure(s) and/or temperature(s), passive valve(s) can be used throughout the system (e.g., control valve(s) 308, 309 and primary vent relief valve (VRV) valve(s) 327, 330). In the example of FIG. 1, the hot secondary flow extract 305 is fed into the vortex tube 302 at vortex tube inlet 310, with cooled air flow 312 moving towards the righthand side of the vortex tube 302 and the hotter air flow 311 moving towards the left hand side of the vortex tube 302 in response to the vortex tube 302 initiating a separation of the air flow(s) 311, 312 from the original hot secondary flow extract 305 entering through the vortex tube inlet 310. As described in connection with FIG. 1, highly compressed air injected into the vortex tube results in a high-speed vortex movement that allows for part of the air to escape through the control valve 145 as leakage flow 158. In the example of FIG. 3, a first ejector tube 316 can use a fraction 315 of the secondary flow originating from the hot secondary flow extract 305 to drive and/or pump the leakage flow 158 of FIG. 1 through the drain line 318 that routes the leakage flow 158 towards the inlet 101 of the pump system 100. In the example of FIG. 3, the hot secondary flow extract 305 entering the vortex tube inlet 310 forms a vortex movement 313 that forces the hotter air flow 311 to move towards the drain line 318. For example, a nozzle 320 forces the whirling airflow entering from the vortex tube inlet 310 to alter its direction and travel through the length of the tube (e.g., as a vortex movement 313). A conical valve 314 at the end of the vortex tube 302 allows a part of the air to escape into the drain line 318, whereas the remaining air reverses direction and moves as a second vortex inside the larger outer vortex, the inner vortex releasing kinetic energy in the form of heat and exiting through the nozzle 320 into a second ejector tube 321 in the form of cooled air flow 312. In some examples, controlling the conical valve 314 (e.g., control valve 145 of FIGS. 1 and/or 2) permits for adjustment of the amount and/or temperature of the cooled air flow 312.

In the example of FIG. 3, the pressure of the cooled air flow 312 entering the second ejector tube 321 is higher (e.g., 4000 psi, etc.) than the pressure of the hotter air flow 311 entering the conical valve 314 (e.g., 1000 psi, etc.). In examples disclosed herein, the control valves 308, 309 can be used to control the amount of addition flow of the hot secondary flow extract 305 entering the first ejector tube 316 and/or the second ejector tube 321. For example, the vortex cooling controller circuitry 190 maintains pressures at the conical valve 314 to push leakage flow 158 into the drain line 318. For example, the control valve 308 can be used to control the hot secondary flow extract fraction 315 entering the first ejector tube 316 (e.g., increased flow leads to increased velocity of leakage flow 158 entering the drain line 318, increasing the pressure at the first ejector tube 316 with respect to the pressure at the inlet 101 of the pump system 100). In some examples, the control valve 309 regulates the flow of hot secondary flow extract 305 into the second ejector tube 321 to push (e.g., eject) the cooled air flow 312 through the second ejector tube 321. In the example of FIG. 3, the cooled air flow 312 can pass through primary vent relief valve(s) (VRV) 323, 327 and/or secondary VRV 330 en route to the pump system bearing inlet 206 of FIG. 2 to provide cooled air flow to the bearings (e.g., thrust bearing 108 of FIGS. 1 and/or 2). While, in the example of FIG. 3, the vortex tube 302 is positioned to provide cooled air flow to the thrust bearing(s) 108, the vortex tube 302 can be positioned in any other way to cool other and/or additional components of the pump system 100 (e.g., cooling jacket 125). Due to the reduction of the air temperature, the air pressure also significantly decreases from the initial pressure associated with the hot secondary flow extract 305 (e.g., a pressure decrease of 75%, etc.).

In the example of FIG. 3, cooled air flow 312 travels towards the pump system bearing inlet 206 via the primary VRV 323 when the cooled air flow 312 has a first pressure 325 (e.g., P1) that is greater than or equal to a target pressure 335 (e.g., Ptarget) needed to enter the pump system 100 via the bearing inlet 206 (e.g., P1≥Ptarget). If the first pressure 325 is lower than the target pressure 335, the cooled air flow 312 continues to travel through the second ejector tube 321. For example, the cooled air flow 312 travels into a convergent nozzle 322, which narrows the airflow, increasing the pressure from the first pressure 325 to a second pressure 328 (e.g., P2). If the second pressure 328 is greater than or equal to the target pressure 335 and the first pressure 325 is less than the target pressure 335 (e.g., P2≥Ptarget, P1 and P1<Ptarget), the cooled air flow 312 travels via the primary VRV 327 and towards the bearing inlet 206. The cooled air flow 312 can further travel into a divergent nozzle 324 after exiting the convergent nozzle 322, resulting in a third pressure 332 (e.g., P3) that exits the second ejector tube 321 via the secondary VRV 330 and is now high enough to match and/or exceed the target pressure 335 needed to travel to the bearing inlet 206. For example, the cooled air flow 312 travels via the secondary VRV 330 towards the pump system 100 when the third pressure 332 is greater than or equal to the target pressure 335 and the second pressure 328 and the first pressure 325 is less than the target pressure 335 (e.g., P3≥Ptarget, P2 and P1<Ptarget).

Figure 4:
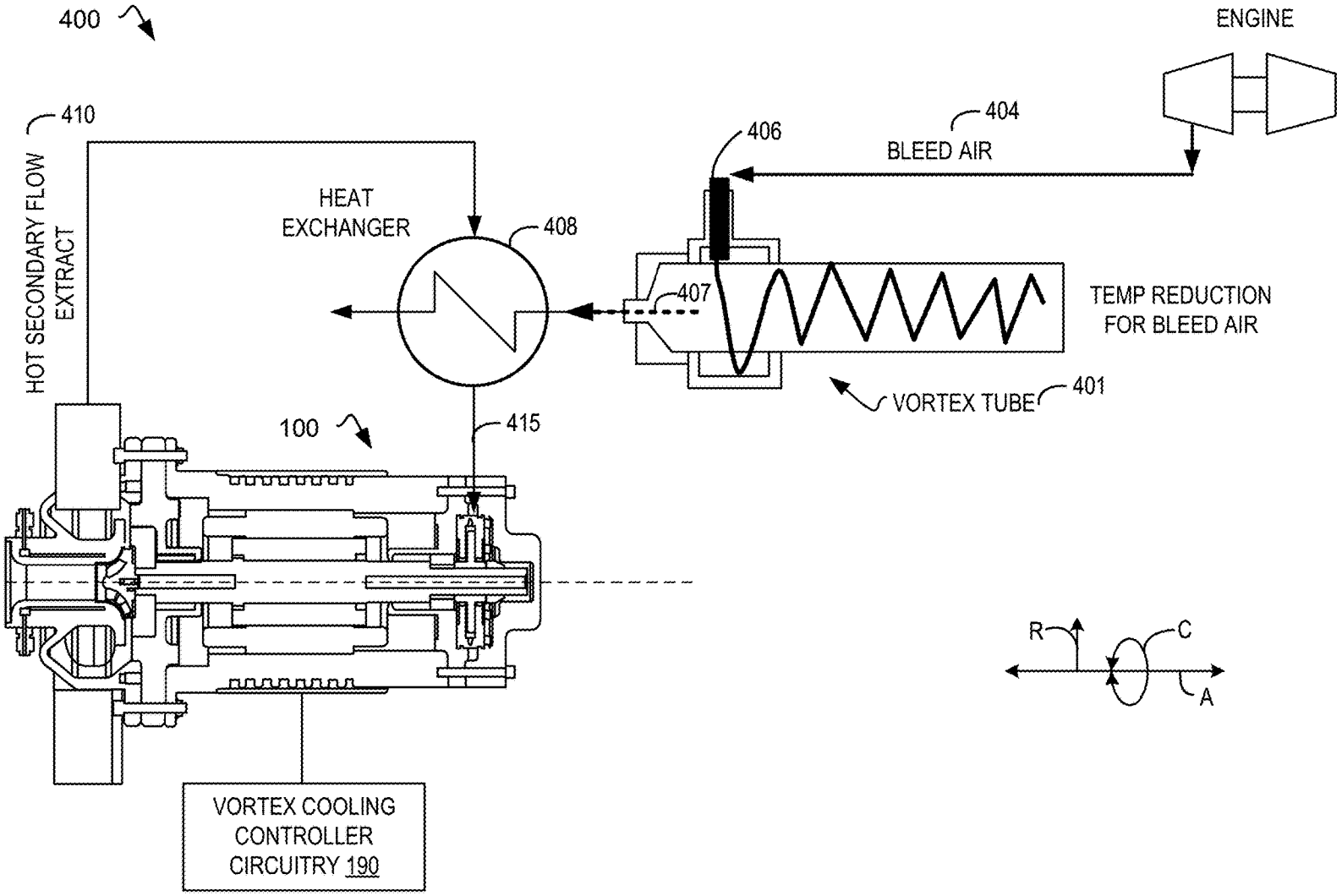
FIG. 4 schematically illustrates an example cross-sectional view of vortex tube as part of a heat exchanger system for cooled lubrication flow provided to bearings of a supercritical carbon dioxide pump in accordance with teachings disclosed herein.

FIG. 4 schematically illustrates an example cross-sectional view 400 of vortex tube 401 as part of a heat exchanger system used to cool lubrication flow provided to bearings of a supercritical carbon dioxide pump system 100 in accordance with teachings disclosed herein. In the example of FIG. 4, compressed air can be bled from an aircraft engine 402 to generate bleed air 404 and pass the bleed air 404 through the vortex tube 401 via a vortex tube inlet 406. For example, as described in connection with FIG. 3, the temperature of the bleed air 404 drops inside the vortex tube 401, resulting in cooled air flow output 407 that is passed from the vortex tube 401 to a heat exchanger 408, such that secondary flow extract is passed through the heat exchanger 408. Likewise, the heat exchanger 408 receives hot secondary flow extract 410 originating from the pump system 100 and can be used to cool the hot secondary flow extract 410 given the incoming cooled air flow output 407 originating from the vortex tube 401, providing cooled air 415 back into the pump system 100 to assist with thermal management of the motor and/or bearings of the pump system 100. In some examples, the vortex cooling controller circuitry 190 controls the amount of cooled air flow output 407 entering the heat exchanger 408 using one or more control valve(s) (e.g., control valve 145 of FIG. 1 and/or conical valve 314 of FIG. 3).

Figure 5:
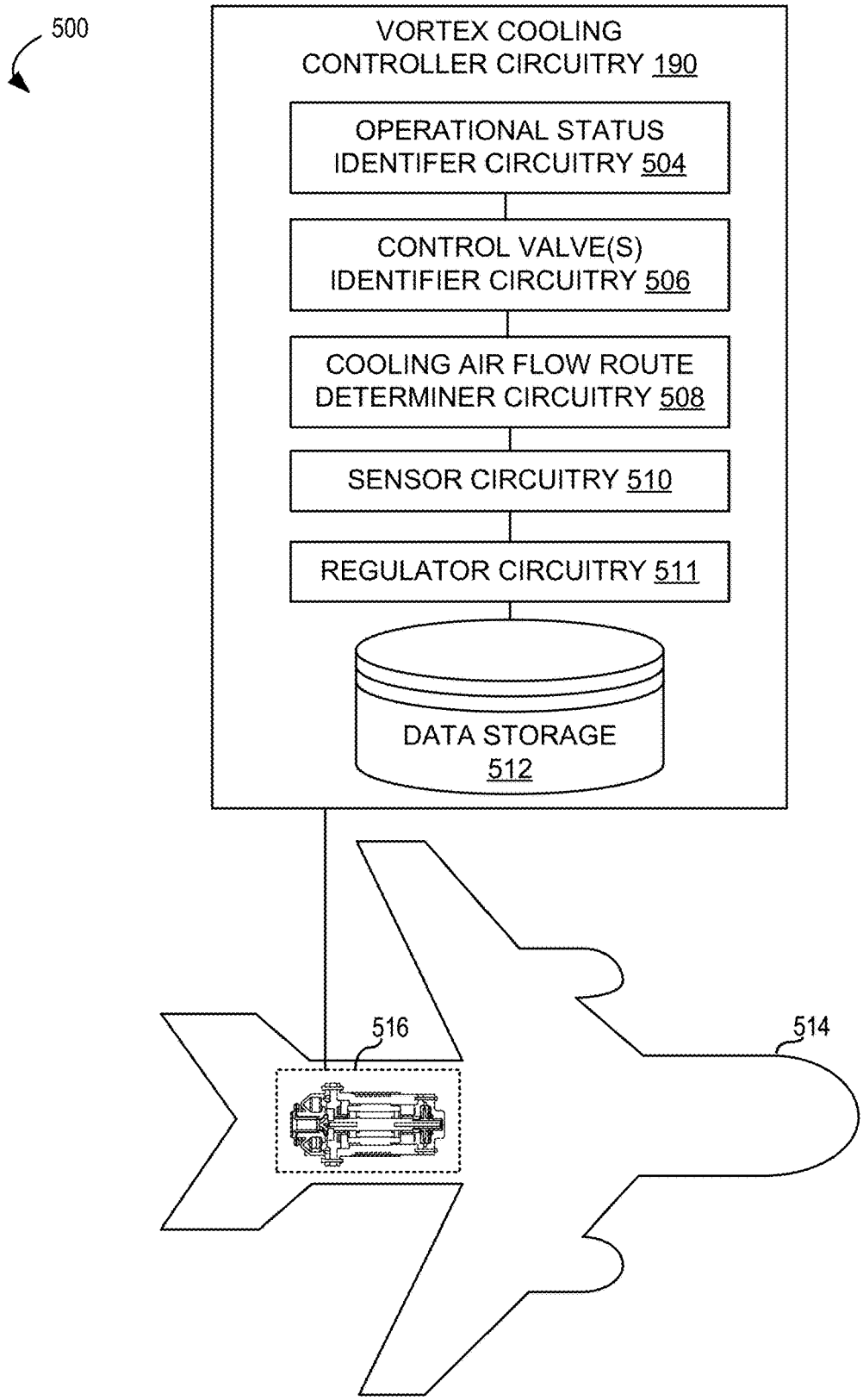
FIG. 5 is a block diagram of an example vortex cooling controller circuitry that may be incorporated into a supercritical carbon dioxide pump developed in accordance with teachings of this disclosure.

FIG. 5 is a block diagram 500 of an example vortex cooling controller circuitry 190 of FIG. 1 that may be incorporated into a supercritical carbon dioxide pump 100 developed in accordance with teachings of this disclosure. The vortex cooling controller circuitry 190 of FIG. 1 may be instantiated (e.g., creating an instance of, bring into being for any length of time, materialize, implement, etc.) by processor circuitry such as a central processing unit executing instructions. Additionally or alternatively, the vortex cooling controller circuitry 190 of FIG. 1 may be instantiated (e.g., creating an instance of, bring into being for any length of time, materialize, implement, etc.) by an ASIC or an FPGA structured to perform operations corresponding to the instructions. It should be understood that some or all of the circuitry of FIG. 5 may, thus be instantiated at the same or different times. Some or all of the circuitry may be instantiated, for example, in one or more threads executing concurrently on hardware and/or in series on hardware. Moreover, in some examples, some or all of the circuitry of FIG. 5 may be implemented by microprocessor circuitry executing instructions to implement one or more virtual machines and/or containers.

The vortex cooling controller circuitry 190 includes example operational status identifier circuitry 504, example control valve(s) identifier circuitry 506, example cooling air flow route determiner circuitry 508, example sensor circuitry 510, example regulator circuitry 511, and an example data storage 512. In the example of FIG. 5, the vortex cooling controller circuitry 190 is in communication with a pump system 516 (e.g., the pump system 100 of FIG. 1) positioned on an aircraft 514.

The operational status identifier circuitry 504 determines an operational status associated with the pump system 100 positioned on the aircraft 514. For example, the operational status identifier circuitry 504 determines whether the pump system 100 (e.g., a supercritical carbon dioxide pump system) is engaged. In some examples, the operational status identifier circuitry 504 determines whether the pump system 100 is operating at desirable temperatures and/or pressures based on sensor circuitry 510 that indicates pressures and/or temperatures throughout the pump system 100. In some examples, the operational status identifier circuitry 504 confirms whether the pump system 100 includes a heat exchanger (e.g., heat exchanger 408) and/or a vortex tube (e.g., vortex tube 128, 202, 302, 401) for routing cooled secondary flow towards the pump system 100 structures that require cooled air for optimal operation (e.g., cooling jacket 125, thrust bearing 108, etc.). In some examples, the operational status identifier circuitry 504 identifies positioning of the vortex tube (e.g., vortex tube 128, 202, 302, 401) with respect to the pump system 100 (e.g., vortex tube 128 positioned for cooling of the cooling jacket and thrust bearings in accordance with FIG. 1, vortex tube 202 positioned for cooling of the bearings 108 in accordance with FIG. 2, and/or vortex tube 401 positioned for cooling of bleed air originating from the aircraft engine, etc.).

The control valve(s) identifier circuitry 506 identifies control valve(s) positioned throughout the vortex tube system. For example, the control valve(s) identifier circuitry 506 determines a number of valve(s) involved in the vortex tube-based thermal management system. In some examples, the control valve(s) identifier circuitry 506 identifies the control valve 145 of FIGS. 1-2 and/or the conical valve 314 of FIG. 3 used to regulate leakage flow exiting into the drain line 318. In some examples, the control valve(s) identifier circuitry 506 identifies control valve(s) associated with regulating hot secondary flow extract 305 entry into the first ejector tube 316 and/or the second ejector tube 321 (e.g., control valve(s) 308, 309). In some examples, the control valve(s) identifier circuitry 506 identifies control valve(s) associated with passing cooled air flow 312 into the pump system bearing inlet 206 (e.g., control valve(s) 323, 327, 330).

The cooling air flow route determiner circuitry 508 identifies the cooled air flow route (e.g., cooled secondary flow 142, 205, 312, 407) based on the output associated with the operational status identifier circuitry 504 and/or the control valve(s) identifier circuitry 506. In some examples, the cooling air flow route determiner circuitry 508 identifies the control valve(s) that are engaged based on the type of vortex tube-based thermal management system being used to provide hot secondary flow extract to the pump system 100.

The sensor circuitry 510 receives input from sensor(s) positioned throughout the pump system 100 and/or the vortex tube (e.g., vortex tube(s) 128, 202, 302, 401). In some examples, the sensor circuitry 510 receives input from temperature sensor(s), pressure sensors(s), and/or any other type(s) of sensor(s) positioned to monitor cooled air flow entering the pump system 100 and/or overall pump system 100 status. In some examples, the sensor circuitry 510 identifies pressure(s) associated with the vortex tube cooling mechanism (e.g., first pressure 325, second pressure 328, third pressure 332, target pressure 335).

The regulator circuitry 511 controls the control valve(s) associated with regulating hot secondary flow extract (e.g., control valve(s) 145, conical valve 314, etc.). For example, based on sensor input received from the sensor circuitry 510 (e.g., originating from temperature sensor(s), pressure sensor(s), etc. positioned throughout the pump system 100 and/or the vortex tube 128, 202, 302, 401), the regulator circuitry 511 regulates cooled air flow traveling towards the pump system 100 to increase and/or decreased air flow temperature, velocity, etc.

The data storage 512 can be used to store any information associated with the operational status identifier circuitry 504, control valve(s) identifier circuitry 506, cooling air flow route determiner circuitry 508, sensor circuitry 510, and/or regulator circuitry 511. The example data storage 512 of the illustrated example of FIG. 5 can be implemented by any memory, storage device and/or storage disc for storing data such as flash memory, magnetic media, optical media, etc. Furthermore, the data stored in the example data storage 512 can be in any data format such as binary data, comma delimited data, tab delimited data, structured query language (SQL) structures, image data, etc.

In some examples, the apparatus includes means for identifying an operational status of the pump system 100. For example, the means for identifying an operational status may be implemented by operational status identifier circuitry 504. In some examples, the operational status identifier circuitry 504 may be instantiated by processor circuitry such as the example processor circuitry 712 of FIG. 7. Additionally or alternatively, the operational status identifier circuitry 504 may be instantiated by any other combination of hardware, software, and/or firmware. For example, the operational status identifier circuitry 504 may be implemented by at least one or more hardware circuits (e.g., processor circuitry, discrete and/or integrated analog and/or digital circuitry, an FPGA, an ASIC, an XPU, a comparator, an operational-amplifier (op-amp), a logic circuit, etc.) structured to execute some or all of the machine readable instructions and/or to perform some or all of the operations corresponding to the machine readable instructions without executing software or firmware, but other structures are likewise appropriate.

In some examples, the apparatus includes means for identifying control valve(s) of the pump system 100. For example, the means for identifying control valves may be implemented by control valve(s) identifier circuitry 506. In some examples, the control valve(s) identifier circuitry 506 may be instantiated by processor circuitry such as the example processor circuitry 712 of FIG. 7. Additionally or alternatively, the control valve(s) identifier circuitry 506 may be instantiated by any other combination of hardware, software, and/or firmware. For example, the control valve(s) identifier circuitry 506 may be implemented by at least one or more hardware circuits (e.g., processor circuitry, discrete and/or integrated analog and/or digital circuitry, an FPGA, an ASIC, an XPU, a comparator, an operational-amplifier (op-amp), a logic circuit, etc.) structured to execute some or all of the machine readable instructions and/or to perform some or all of the operations corresponding to the machine readable instructions without executing software or firmware, but other structures are likewise appropriate.

In some examples, the apparatus includes means for determining a cooling air flow route. For example, the means for determining a cooling air flow route may be implemented by cooling air flow route determiner circuitry 508. In some examples, the cooling air flow route determiner circuitry 508 may be instantiated by processor circuitry such as the example processor circuitry 712 of FIG. 7. Additionally or alternatively, the cooling air flow route determiner circuitry 508 may be instantiated by any other combination of hardware, software, and/or firmware. For example, the cooling air flow route determiner circuitry 508 may be implemented by at least one or more hardware circuits (e.g., processor circuitry, discrete and/or integrated analog and/or digital circuitry, an FPGA, an ASIC, an XPU, a comparator, an operational-amplifier (op-amp), a logic circuit, etc.) structured to execute some or all of the machine readable instructions and/or to perform some or all of the operations corresponding to the machine readable instructions without executing software or firmware, but other structures are likewise appropriate.

In some examples, the apparatus includes means for sensing. For example, the means for sensing may be implemented by sensor circuitry 510. In some examples, the sensor circuitry 510 may be instantiated by processor circuitry such as the example processor circuitry 712 of FIG. 7. Additionally or alternatively, the sensor circuitry 510 may be instantiated by any other combination of hardware, software, and/or firmware. For example, the sensor circuitry 510 may be implemented by at least one or more hardware circuits (e.g., processor circuitry, discrete and/or integrated analog and/or digital circuitry, an FPGA, an ASIC, an XPU, a comparator, an operational-amplifier (op-amp), a logic circuit, etc.) structured to execute some or all of the machine readable instructions and/or to perform some or all of the operations corresponding to the machine readable instructions without executing software or firmware, but other structures are likewise appropriate.

In some examples, the apparatus includes means for regulating. For example, the means for regulating may be implemented by regulator circuitry 511. In some examples, the regulator circuitry 511 may be instantiated by processor circuitry such as the example processor circuitry 712 of FIG. 7. Additionally or alternatively, the regulator circuitry 511 may be instantiated by any other combination of hardware, software, and/or firmware. For example, the regulator circuitry 511 may be implemented by at least one or more hardware circuits (e.g., processor circuitry, discrete and/or integrated analog and/or digital circuitry, an FPGA, an ASIC, an XPU, a comparator, an operational-amplifier (op-amp), a logic circuit, etc.) structured to execute some or all of the machine readable instructions and/or to perform some or all of the operations corresponding to the machine readable instructions without executing software or firmware, but other structures are likewise appropriate.

While an example manner of implementing the vortex cooling controller circuitry 190 of FIG. 1 is illustrated in FIG. 5, one or more of the elements, processes, and/or devices illustrated in FIG. 5 may be combined, divided, re-arranged, omitted, eliminated, and/or implemented in any other way. Further, the operational status identifier circuitry 504, control valve(s) identifier circuitry 506, cooling air flow route determiner circuitry 508, sensor circuitry 510, regulator circuitry 511, and/or, more generally, the vortex cooling controller circuitry 190 of FIG. 1, may be implemented by hardware, software, firmware, and/or any combination of hardware, software, and/or firmware. Thus, for example, any of the operational status identifier circuitry 504, control valve(s) identifier circuitry 506, cooling air flow route determiner circuitry 508, sensor circuitry 510, regulator circuitry 511, and/or, more generally, the example vortex cooling controller circuitry 190 of FIG. 1, could be implemented by processor circuitry, analog circuit(s), digital circuit(s), logic circuit(s), programmable processor(s), programmable microcontroller(s), graphics processing unit(s) (GPU(s)), digital signal processor(s) (DSP(s)), application specific integrated circuit(s) (ASIC(s)), programmable logic device(s) (PLD(s)), and/or field programmable logic device (s) (FPLD(s)) such as Field Programmable Gate Arrays (FPGAs). Further still, the example vortex cooling controller circuitry 190 may include one or more elements, processes, and/or devices in addition to, or instead of, those illustrated in FIG. 5, and/or may include more than one of any or all of the illustrated elements, processes and devices.

Figure 6:
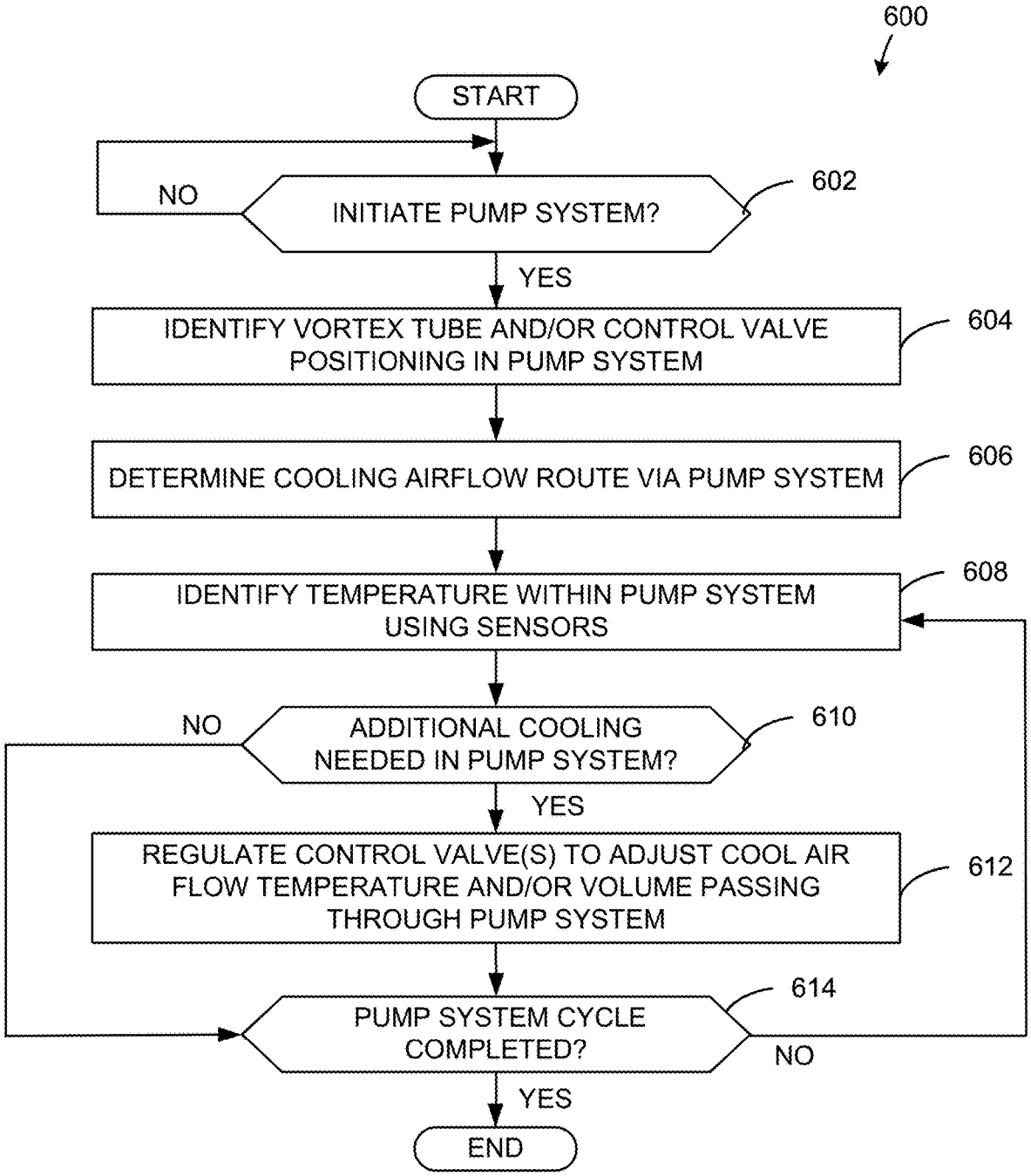
FIG. 6 is a flowchart representative of example machine readable instructions that may be executed by example processor circuitry to implement the vortex cooling controller circuitry of FIG. 5.

A flowchart representative of example hardware logic circuitry, machine readable instructions, hardware implemented state machines, and/or any combination thereof for implementing the vortex cooling controller circuitry 190 is shown in FIG. 6. The machine readable instructions may be one or more executable programs or portion(s) of an executable program for execution by processor circuitry, such as the processor circuitry 712 shown in the example processor platform 700 discussed below in connection with FIG. 7. The program may be embodied in software stored on one or more non-transitory computer readable storage media such as a compact disk (CD), a floppy disk, a hard disk drive (HDD), a solid-state drive (SSD), a digital versatile disk (DVD), a Blu-ray disk, a volatile memory (e.g., Random Access Memory (RAM) of any type, etc.), or a non-volatile memory (e.g., electrically erasable programmable read-only memory (EEPROM), FLASH memory, an HDD, an SSD, etc.) associated with processor circuitry located in one or more hardware devices, but the entire program and/or parts thereof could alternatively be executed by one or more hardware devices other than the processor circuitry and/or embodied in firmware or dedicated hardware. The machine readable instructions may be distributed across multiple hardware devices and/or executed by two or more hardware devices (e.g., a server and a client hardware device). For example, the client hardware device may be implemented by an endpoint client hardware device (e.g., a hardware device associated with a user) or an intermediate client hardware device (e.g., a radio access network (RAN)) gateway that may facilitate communication between a server and an endpoint client hardware device). Similarly, the non-transitory computer readable storage media may include one or more mediums located in one or more hardware devices. Further, although the example program(s) are described with reference to the flowchart illustrated in FIG. 6, many other methods of implementing the example vortex cooling controller circuitry 190 of FIG. 1 may alternatively be used. For example, the order of execution of the blocks may be changed, and/or some of the blocks described may be changed, eliminated, or combined. Additionally or alternatively, any or all of the blocks may be implemented by one or more hardware circuits (e.g., processor circuitry, discrete and/or integrated analog and/or digital circuitry, an FPGA, an ASIC, a comparator, an operational-amplifier (op-amp), a logic circuit, etc.) structured to perform the corresponding operation without executing software or firmware. The processor circuitry may be distributed in different network locations and/or local to one or more hardware devices (e.g., a single-core processor (e.g., a single core central processor unit (CPU)), a multi-core processor (e.g., a multi-core CPU, an XPU, etc.) in a single machine, multiple processors distributed across multiple servers of a server rack, multiple processors distributed across one or more server racks, a CPU and/or a FPGA located in the same package (e.g., the same integrated circuit (IC) package or in two or more separate housings, etc.).

The machine readable instructions described herein may be stored in one or more of a compressed format, an encrypted format, a fragmented format, a compiled format, an executable format, a packaged format, etc. Machine readable instructions as described herein may be stored as data or a data structure (e.g., as portions of instructions, code, representations of code, etc.) that may be utilized to create, manufacture, and/or produce machine executable instructions. For example, the machine readable instructions may be fragmented and stored on one or more storage devices and/or computing devices (e.g., servers) located at the same or different locations of a network or collection of networks (e.g., in the cloud, in edge devices, etc.). The machine readable instructions may require one or more of installation, modification, adaptation, updating, combining, supplementing, configuring, decryption, decompression, unpacking, distribution, reassignment, compilation, etc., in order to make them directly readable, interpretable, and/or executable by a computing device and/or other machine. For example, the machine readable instructions may be stored in multiple parts, which are individually compressed, encrypted, and/or stored on separate computing devices, wherein the parts when decrypted, decompressed, and/or combined form a set of machine executable instructions that implement one or more operations that may together form a program such as that described herein.

In another example, the machine readable instructions may be stored in a state in which they may be read by processor circuitry, but require addition of a library (e.g., a dynamic link library (DLL)), a software development kit (SDK), an application programming interface (API), etc., in order to execute the machine readable instructions on a particular computing device or other device. In another example, the machine readable instructions may need to be configured (e.g., settings stored, data input, network addresses recorded, etc.) before the machine readable instructions and/or the corresponding program(s) can be executed in whole or in part. Thus, machine readable media, as used herein, may include machine readable instructions and/or program(s) regardless of the particular format or state of the machine readable instructions and/or program(s) when stored or otherwise at rest or in transit.

The machine readable instructions described herein can be represented by any past, present, or future instruction language, scripting language, programming language, etc. For example, the machine readable instructions may be represented using any of the following languages: C, C++, Java, C#, Perl, Python, JavaScript, HyperText Markup Language (HTML), Structured Query Language (SQL), Swift, etc.

As mentioned above, the example operations of FIG. 6 may be implemented using executable instructions (e.g., computer and/or machine readable instructions) stored on one or more non-transitory computer and/or machine readable media such as optical storage devices, magnetic storage devices, an HDD, a flash memory, a read-only memory (ROM), a CD, a DVD, a cache, a RAM of any type, a register, and/or any other storage device or storage disk in which information is stored for any duration (e.g., for extended time periods, permanently, for brief instances, for temporarily buffering, and/or for caching of the information). As used herein, the terms non-transitory computer readable medium, non-transitory computer readable storage medium, non-transitory machine readable medium, and non-transitory machine readable storage medium are expressly defined to include any type of computer readable storage device and/or storage disk and to exclude propagating signals and to exclude transmission media. As used herein, the terms "computer readable storage device" and "machine readable storage device" are defined to include any physical (mechanical and/or electrical) structure to store information, but to exclude propagating signals and to exclude transmission media. Examples of computer readable storage devices and machine readable storage devices include random access memory of any type, read only memory of any type, solid state memory, flash memory, optical discs, magnetic disks, disk drives, and/or redundant array of independent disks (RAID) systems. As used herein, the term "device" refers to physical structure such as mechanical and/or electrical equipment, hardware, and/or circuitry that may or may not be configured by computer readable instructions, machine readable instructions, etc., and/or manufactured to execute computer readable instructions, machine readable instructions, etc.

FIG. 6 is a flowchart representative of example machine readable instructions 600 that may be executed by example processor circuitry to implement the vortex cooling controller circuitry 190 of FIG. 5. In the example of FIG. 6, the operational status identifier circuitry 504 determines an operational status of the pump system 100 (e.g., on/off status). In some examples, the operational status identifier circuitry 504 identifies whether the pump system 100 should be initiated based on an operational status of another system with which the pump system 100 is associated (e.g., an aircraft, a gas turbine engine, etc.) (block 602). In the example of FIG. 6, the control valve(s) identifier circuitry 506 identifies vortex tube and/or control valve positioning in the pump system 100 (block 604). For example, the control valve(s) identifier circuitry 506 identifies how the vortex tube is linked to the pump system 100 (e.g., as vortex tube 128 of FIG. 1 to provide cooled air flow to the cooling jacket and thrust bearings, as vortex tube 202 of FIG. 2 to provide cooled air flow to the thrust bearings directly, and/or as vortex tube 401 of FIG. 4 to provide cooled air flow output 407 to the heat exchanger 408). The control valve(s) identifier circuitry 506 identifies control valve(s) associated with a particular positioning of the vortex tube system (e.g., control valve 145 of FIG. 1 and/or 2, conical valve 314 of FIG. 3, control valve(s) 308, 309, 323, 327, 330 of FIG. 4, etc.). In the example of FIG. 6, the cooling air flow route determiner circuitry 508 determines the cooling air flow route via the pump system 100 (block 606). For example, the cooling air flow route determiner circuitry 508 identifies a pathway of the cooled air flow originating from the vortex tube based on the positioning of the vortex tube and/or the positioning of the control valve(s) associated with the thermal management system used to provide cooled air flow to the pump system 100 components (e.g., cooling jacket, thrust bearings, etc.). For example, multiple pump system(s) 100 may be present in one location, such that identification of the positioning of the vortex tube(s) in the system facilitates regulation of cooled secondary air flow from the vortex tube(s) towards the pump system(s). The sensor circuitry 510 identifies temperature(s) and/or pressure(s) throughout the pump system 100 and/or the vortex tube components (e.g., first ejector tube 316, second ejector tube 321, etc.) (block 608). For example, the sensor circuitry 510 determines temperature(s) and/or pressure(s) at various areas of the vortex tube system (e.g., first ejector tube 316, second ejector tube 321) and/or compares required pressure measurements (e.g., target pressure 335) to the pressure readings associated with the first pressure 325, the second pressure 328, and/or the third pressure 332. In some examples, the regulator circuitry 511 determines whether additional cooling is needed in the pump system 100 based on sensor readings taken at various regions that may require cooled air flow (e.g., thrust bearings, cooling jacket, etc.) (block 610). If additional cooling is warranted (e.g., actual temperature is higher than the required temperature), the regulator circuitry 511 regulates the temperature, pressure, and/or airflow velocity using the control valve(s) 145, the conical valve(s) 314, and/or any other valve(s) positioned throughout the thermal management system (e.g., control valve(s) 308, 309, 323, 327, 330, etc.). For example, the regulator circuitry 511 regulates the control valve(s) to adjust cooled air flow temperature, velocity, and/or volume passing through the pump system (block 612). For example, while some control valve(s) in the system are passive, active control valve(s) can be regulated using the regulator circuitry 511. Once the operational status identifier circuitry 504 determines that the pump system cycle is completed (block 614), the vortex cooling controller circuitry 190 is on standby until the pump system is active again. Otherwise, if the operational status identifier circuitry 504 determines that the pump system cycle is not yet completed, additional readings can be acquired using the sensor circuitry 510 to determine if additional cooling is to be performed and initiate adjustments using the regulator circuitry 511.

Figure 7:
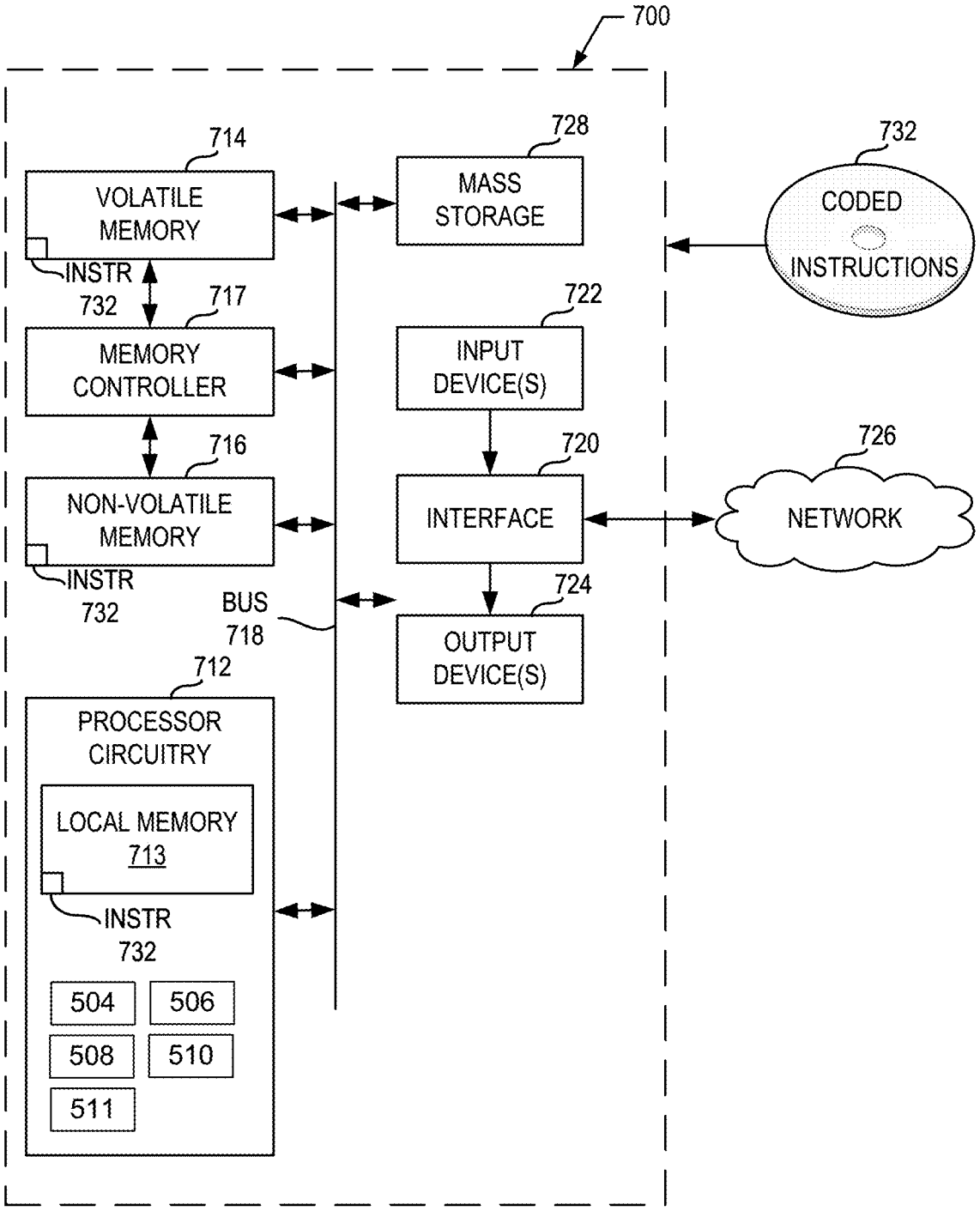
FIG. 7 is a block diagram of an example processing platform including processor circuitry structured to execute the example machine readable instructions and/or the example operations of FIG. 6 to implement the vortex cooling controller circuitry of FIG. 5.

FIG. 7 is a block diagram of an example processor platform 700 structured to execute and/or instantiate the machine readable instructions and/or operations of FIG. 6 to implement the vortex cooling controller circuitry 190 of FIG. 1. The processor platform 700 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a DVD player, a CD player, a digital video recorder, a Blu-ray player, a gaming console, a personal video recorder, a set top box, a headset (e.g., an augmented reality (AR) headset, a virtual reality (VR) headset, etc.) or other wearable device, or any other type of computing device.

The processor platform 700 of the illustrated example includes processor circuitry 712. The processor circuitry 712 of the illustrated example is hardware. For example, the processor circuitry 712 can be implemented by one or more integrated circuits, logic circuits, FPGAs microprocessors, CPUs, GPUs, DSPs, and/or microcontrollers from any desired family or manufacturer. The processor circuitry 712 may be implemented by one or more semiconductor based (e.g., silicon based) devices. In this example, the processor circuitry 712 implements the operational status identifier circuitry 504, control valve(s) identifier circuitry 506, cooling air flow route determiner circuitry 508, sensor circuitry 510, and/or regulator circuitry 511.

The processor circuitry 712 of the illustrated example includes a local memory 713 (e.g., a cache, registers, etc.). The processor circuitry 712 of the illustrated example is in communication with a main memory including a volatile memory 714 and a non-volatile memory 716 by a bus 718. The volatile memory 714 may be implemented by Synchronous Dynamic Random Access Memory (SDRAM), Dynamic Random Access Memory (DRAM), RAMBUS® Dynamic Random Access Memory (RDRAM®), and/or any other type of RAM device. The non-volatile memory 716 may be implemented by flash memory and/or any other desired type of memory device. Access to the main memory 714, 716 of the illustrated example is controlled by a memory controller 717.

The processor platform 700 of the illustrated example also includes interface circuitry 720. The interface circuitry 720 may be implemented by hardware in accordance with any type of interface standard, such as an Ethernet interface, a universal serial bus (USB) interface, a Bluetooth® interface, a near field communication (NFC) interface, a Peripheral Component Interconnect (PCI) interface, and/or a Peripheral Component Interconnect Express (PCIe) interface.

In the illustrated example, one or more input devices 722 are connected to the interface circuitry 720. The input device(s) 722 permit(s) a user to enter data and/or commands into the processor circuitry 712. The input device(s) 722 can be implemented by, for example, an audio sensor, a microphone, a camera (still or video), a keyboard, a button, a mouse, a touchscreen, a track-pad, a trackball, an isopoint device, and/or a voice recognition system.

One or more output devices 724 are also connected to the interface circuitry 720 of the illustrated example. The output devices 724 can be implemented, for example, by display devices (e.g., a light emitting diode (LED), an organic light emitting diode (OLED), a liquid crystal display (LCD), a cathode ray tube (CRT) display, an in-place switching (IPS) display, a touchscreen, etc.), a tactile output device, a printer, and/or speaker. The interface circuitry 720 of the illustrated example, thus, typically includes a graphics driver card, a graphics driver chip, and/or graphics processor circuitry such as a GPU.

The interface circuitry 720 of the illustrated example also includes a communication device such as a transmitter, a receiver, a transceiver, a modem, a residential gateway, a wireless access point, and/or a network interface to facilitate exchange of data with external machines (e.g., computing devices of any kind) by a network 726. The communication can be by, for example, an Ethernet connection, a digital subscriber line (DSL) connection, a telephone line connection, a coaxial cable system, a satellite system, a line-of-site wireless system, a cellular telephone system, an optical connection, etc.

The processor platform 700 of the illustrated example also includes one or more mass storage devices 728 to store software and/or data. Examples of such mass storage devices 728 include magnetic storage devices, optical storage devices, floppy disk drives, HDDs, CDs, Blu-ray disk drives, redundant array of independent disks (RAID) systems, solid state storage devices such as flash memory devices, and DVD drives.

The machine executable instructions 732, which may be implemented by the machine readable instructions of FIG. 6, may be stored in the mass storage device 728, in the volatile memory 714, in the non-volatile memory 716, and/or on a removable non-transitory computer readable storage medium such as a CD or DVD.

From the foregoing, it will be appreciated that example systems, methods, apparatus, and articles of manufacture have been disclosed that permit the use of a vortex tube in place of heat exchangers to control thermal energy to maintain working fluids and/or components of a system within a certain temperature range. In examples disclosed herein, compressed air from an engine (e.g., an aircraft engine) can be passed through the vortex tube, causing an air temperature drop in the vortex tube, with the resulting cooled air passed through a heat exchanger. Furthermore, the use of the vortex tube can be used to eliminate additional weight associated with heat exchanger(s) and/or existing heat exchanger network(s) for secondary flow and motor cooling. As such, methods and apparatus disclosed herein for vortex cooled secondary flow for a supercritical carbon dioxide pump improve overall electrical motor stability and reliability through effective thermal management.

Example methods and apparatus for vortex cooled secondary flow for a supercritical carbon dioxide pump are disclosed herein. Further examples and combinations thereof include the following:

Example 1 includes a thermal management system, comprising a hot secondary flow extract section fluidly coupled to an outlet of a pump system, a cooled secondary flow section fluidly coupled to the hot secondary flow extract section, the hot secondary flow extract section including a vortex tube to generate cooled secondary air flow from hot secondary flow extract air of the hot secondary flow extract section, and a bearing inlet fluidly coupled to the cooled secondary flow section, the bearing inlet positioned to route the cooled secondary flow to bearings of the pump system.

Example 2 includes the thermal management system of any preceding clause, wherein the cooled secondary flow section is fluidly coupled to a cooling jacket of the pump system.

Example 3 includes the thermal management system of any preceding clause, wherein the vortex tube includes a control valve to regulate leakage flow exiting the vortex tube.

Example 4 includes the thermal management system of any preceding clause, wherein the vortex tube includes a first ejector tube and a second ejector tube, the first ejector tube to receive leakage flow of the hot secondary air flow extract and the second ejector tube to receive cooled secondary air flow passing towards the bearing inlet.

Example 5 includes the thermal management system of any preceding clause, further including a first control valve and a second control valve, the first control valve fluidly coupled to the first ejector tube and the second control valve fluidly coupled to the second ejector tube.

Example 6 includes the thermal management system of any preceding clause, wherein the second ejector tube includes a convergent nozzle and a divergent nozzle.

Example 7 includes the thermal management system of any preceding clause, wherein the convergent nozzle directs cooled air flow through a primary vent relief valve towards the bearing inlet and the divergent nozzle directs cooled air flow through a secondary vent relief valve towards the bearing inlet.

Example 8 includes the thermal management system of any preceding clause, wherein the cooled secondary air flow passes through the convergent nozzle or the divergent nozzle when an actual pressure of the cooled secondary air flow is less than a required pressure.

Example 9 includes the thermal management system of any preceding clause, wherein the pump system includes a supercritical carbon dioxide pump.

Example 10 includes a thermal management system, comprising a vortex tube fluidly coupled to an aircraft engine, and a heat exchanger fluidly coupled to the vortex tube to cool incoming hot secondary flow extract from an outlet of a pump system, wherein the heat exchanger is to generate cooled secondary air flow to cool at least one of a cooling jacket or a thrust bearing of the pump system.

Example 11 includes the thermal management system of any preceding clause, wherein the vortex tube is to reduce a temperature air entering the vortex tube from the aircraft engine, the air split into a hot air flow extract and the cooled air flow extract inside the vortex tube.

Example 12 includes the thermal management system of any preceding clause, wherein the vortex tube includes a control valve to regulate at least one of a temperature or a velocity of the cooled air flow extract passing to the heat exchanger.

Example 13 includes the thermal management system of any preceding clause, wherein the control valve is to regulate leakage flow exiting the vortex tube, the leakage flow including the hot air flow extract.

Example 14 includes the thermal management system of any preceding clause, wherein the pump system is a supercritical carbon dioxide pump system.

Example 15 includes an apparatus, comprising memory, instructions, and processor circuitry to execute the instructions to identify one or more control valves positioned to regulate a flow of cooled secondary air from a vortex tube to a pump system, determine at least one of a temperature or a pressure of the cooled secondary air entering the pump system, and regulate the one or more control valves to reduce a temperature of the cooled secondary air exiting the vortex tube, the cooled secondary air to cool at least one of a cooling jacket or a thrust bearing of the pump system.

Example 16 includes the apparatus of any preceding clause, wherein the processor circuitry is to identify a pressure of hot secondary flow extract entering the vortex tube from the pump system.

Example 17 includes the apparatus of any preceding clause, wherein the processor circuitry is to regulate a first control valve or a second control valve to route the hot secondary flow extract towards at least one of a conical valve or an ejector tube, the ejector tube positioned inside the vortex tube.

Example 18 includes the apparatus of any preceding clause, wherein the processor circuitry is to regulate flow through the conical valve to control leakage flow from the vortex tube, the leakage flow entering a drain pipe to return the leakage flow to an inlet of the pump system.

Example 19 includes the apparatus of any preceding clause, wherein the processor circuitry is to regulate the cooled secondary air flow through a convergent nozzle or a divergent nozzle of the ejector tube.

Example 20 includes the apparatus of any preceding clause, wherein the processor circuitry is to regulate a primary vent relief valve or a secondary vent relief valve when a pressure of the cooled secondary air is less than a required pressure to enter a bearing inlet of the pump system.

Example 21 includes an apparatus, comprising means for identifying one or more control valves positioned to regulate a flow of cooled secondary air from a vortex tube to a pump system, means for determining at least one of a temperature or a pressure of the cooled secondary air entering the pump system, means for regulating at least one or more of the control valves to reduce a temperature of the cooled secondary air exiting the vortex tube, the cooled secondary air to cool at least one of a cooling jacket or a thrust bearing of the pump system.

Example 22 includes the apparatus of any preceding clause, wherein the means for determining at least one of a temperature or a pressure includes identifying a pressure of hot secondary flow extract entering the vortex tube from the pump system.

Example 23 includes the apparatus of any preceding clause, wherein the means for regulating is to regulate a first control valve or a second control valve to route the hot secondary flow extract towards at least one of a conical valve or an ejector tube, the ejector tube positioned inside the vortex tube.

Example 24 includes the apparatus of any preceding clause, wherein the means for regulating is to regulate flow through the conical valve to control leakage flow from the vortex tube, the leakage flow entering a drain pipe to return leakage flow to an inlet of the pump system.

Example 25 includes the apparatus of any preceding clause, wherein the means for regulating is to regulate the cooled secondary air flow through a convergent nozzle or a divergent nozzle of the ejector tube.

Example 26 includes the apparatus of any preceding clause, wherein the means for regulating is to regulate a primary vent relief valve or a secondary vent relief valve when a pressure of the cooled secondary air is less than a required pressure to enter a bearing inlet of the pump system.

Example 27 includes a method, comprising identifying one or more control valves positioned to regulate a flow of cooled secondary air from a vortex tube to a pump system, determining at least one of a temperature or a pressure of the cooled secondary air entering the pump system, regulating at least one or more of the control valves to reduce a temperature of the cooled secondary air exiting the vortex tube, the cooled secondary air to cool at least one of a cooling jacket or a thrust bearing of the pump system.

Example 28 includes the method of any preceding clause, further including identifying a pressure of hot secondary flow extract entering the vortex tube from the pump system.

Example 29 includes the method of any preceding clause, further including regulating a first control valve or a second control valve to route the hot secondary flow extract towards at least one of a conical valve or an ejector tube, the ejector tube positioned inside the vortex tube.

Example 30 includes the method of any preceding clause, further including regulating flow through the conical valve to control leakage flow from the vortex tube, the leakage flow entering a drain pipe to return leakage flow to an inlet of the pump system.

Example 31 includes the method of any preceding clause, further including regulating the cooled secondary air flow through a convergent nozzle or a divergent nozzle of the ejector tube.

Example 32 includes the method of any preceding clause, further including regulating a primary vent relief valve or a secondary vent relief valve when a pressure of the cooled secondary air is less than a required pressure to enter a bearing inlet of the pump system.

Example 33 includes a thermal management system, comprising an outlet of a pump system, a hot secondary flow extract section to route hot secondary air flow exiting the pump system outlet, a cooled secondary flow section positioned to receive cooled secondary air flow, the cooled secondary air flow generated inside a vortex tube positioned to receive the hot secondary flow extract air, and a bearing inlet to route the cooled secondary flow towards bearings of the pump system.

Example 34 includes the thermal management system of any preceding clause, wherein the cooled secondary flow section is to direct cooled secondary air flow towards a cooling jacket of the pump system.

Example 35 includes the thermal management system of any preceding clause, wherein the vortex tube includes a control valve to regulate leakage flow exiting the vortex tube.

Example 36 includes the thermal management system of any preceding clause, wherein the vortex tube includes a first ejector tube and a second ejector tube, the first ejector tube to receive hot secondary air flow extract leakage flow and the second ejector tube to receive cooled secondary air flow passing towards the bearing inlet.

Example 37 includes the thermal management system of any preceding clause, further including a first control valve and a second control valve, the first control valve to regulate hot secondary air flow extract into the first ejector tube and the second control valve to regular hot secondary air flow extract into the second ejector tube.

Example 38 includes the thermal management system of any preceding clause, wherein the second ejector tube includes a convergent nozzle and a divergent nozzle.

Example 39 includes the thermal management system of any preceding clause, wherein the convergent nozzle directs cooled air flow through a primary vent relief valve towards the bearing inlet and the divergent nozzle directs cooled air flow through a secondary vent relief valve towards the bearing inlet.

Example 40 includes the thermal management system of any preceding clause, wherein the cooled secondary air flow passes through the convergent nozzle or the divergent nozzle when an actual pressure of the cooled secondary air flow is less than a required pressure.

Example 41 includes the thermal management system of any preceding clause, wherein the pump system includes a supercritical carbon dioxide pump.

Example 42 includes a thermal management system, comprising a vortex tube positioned to receive bleed air from an aircraft engine, and a heat exchanger positioned to receive cooled air flow from the vortex tube, the cooled air flow to cool incoming hot secondary flow extract from an outlet of a pump system, the pump system positioned to receive cooled secondary air flow from the heat exchanger, wherein the cooled secondary air flow from the heat exchanger is to cool at least one of a cooling jacket or a thrust bearing of the pump system.

Example 43 includes the thermal management system of any preceding clause, wherein the vortex tube is to reduce a temperature of the bleed air entering the vortex tube from the aircraft engine, the bleed air split into a hot air flow extract and the cooled air flow extract inside the vortex tube.

Example 44 includes the thermal management system of any preceding clause, wherein the vortex tube includes a control valve to regulate at least one of a temperature or a velocity of the cooled air flow extract passing to the heat exchanger.

Example 45 includes the thermal management system of any preceding clause, wherein the control valve is to regulate leakage flow exiting the vortex tube, the leakage flow including the hot air flow extract.

Example 46 includes the thermal management system of any preceding clause, wherein the pump system is a supercritical carbon dioxide pump system.

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. A thermal management system, comprising:

a hot secondary flow extract section fluidly coupled to an outlet of a pump system;

a cooled secondary flow section fluidly coupled to the hot secondary flow extract section, the hot secondary flow extract section including a vortex tube to generate cooled secondary air flow from hot secondary flow extract air of the hot secondary flow extract section; and a bearing inlet fluidly coupled to the cooled secondary flow section, the bearing inlet positioned to route the cooled secondary air flow to bearings of the pump system, wherein the vortex tube includes a first ejector tube and a second ejector tube, the first ejector tube to receive leakage flow of the hot secondary flow extract air and the second ejector tube to receive the cooled secondary air flow passing towards the bearing inlet.

2. The thermal management system of claim 1, wherein the cooled secondary flow section is fluidly coupled to a cooling jacket of the pump system.

3. The thermal management system of claim 1, wherein the vortex tube includes a control valve to regulate leakage flow exiting the vortex tube.

4. The thermal management system of claim 1, further including a first control valve and a second control valve, the first control valve fluidly coupled to the first ejector tube and the second control valve fluidly coupled to the second ejector tube.

5. The thermal management system of claim 4, wherein the second ejector tube includes a convergent nozzle and a divergent nozzle.

6. The thermal management system of claim 5, wherein the convergent nozzle directs cooled air flow through a primary vent relief valve towards the bearing inlet and the divergent nozzle directs cooled air flow through a secondary vent relief valve towards the bearing inlet.

7. The thermal management system of claim 5, wherein the cooled secondary air flow passes through the convergent nozzle or the divergent nozzle when an actual pressure of the cooled secondary air flow is less than a required pressure.

8. The thermal management system of claim 1, wherein the pump system includes a supercritical carbon dioxide pump.

* * * * *